United States Patent [19]

Vehling et al.

[11] 4,169,397

[45] Oct. 2, 1979

[54] DEVICE FOR PROCESSING A FIBROUS CABLE CONTINUOUSLY FED AT A HIGH SPEED

[75] Inventors: Ernst Vehling, Bordesholm; Johann Ratjen, Willenscharen, both of Fed. Rep. of Germany

[73] Assignee: Neumünstersche Maschinen- und Apparatebau Gesellschaft mbH, Neumünster, Fed. Rep. of Germany

[21] Appl. No.: 901,292

[22] Filed: May 1, 1978

[30] Foreign Application Priority Data

May 13, 1977 [DE] Fed. Rep. of Germany ..... 2721665
May 20, 1977 [DE] Fed. Rep. of Germany ..... 2722788

[51] Int. Cl.[2] ..... D01G 1/04

[52] U.S. Cl. ..... 83/100; 83/401; 83/402; 83/431; 83/913; 242/54.4

[58] Field of Search ..... 83/100, 331, 431, 913, 83/402, 401; 242/54.4

[56] References Cited

U.S. PATENT DOCUMENTS 4,014,231 3/1977 Hutzezon ..... 83/913 X

*Primary Examiner*—J. M. Meister

*Attorney, Agent, or Firm*—Michael J. Striker

[57] ABSTRACT

A method of processing a fibrous cable fed at a high speed comprises the steps of braking the cable by coiling it on a stationary cylinder and simultaneously discharging at a low speed the lower cable windings by exerting downward pressure on the upper windings. The discharged windings can be deposited into containers or cut into staple fibers by pressing the discharged windings against stationary knives. A device for carrying out the method comprises an upright rotatable shaft having a hollow upper part for receiving the cable, a downwardly projecting guiding member attached to and communicating with the hollow upper part, a stationary cylinder surrounding the lower portion of the shaft and having in its cylindrical wall a plurality of vertical slits, a wobble plate disposed within the cylinder and having a plurality of fingers projecting through the vertical slits in the cylindrical wall. The wobbling movement of the plate is synchronized with the circular movement of the guiding member such that the fingers in the highest position of their swivel are always opposite to the outlet opening of the guiding member so that the cable is wound on the cylindrical wall under the pressure of the wobble plate fingers.

15 Claims, 4 Drawing Figures

DEVICE FOR PROCESSING A FIBROUS CABLE CONTINUOUSLY FED AT A HIGH SPEED

BACKGROUND OF THE INVENTION

This invention relates generally to a method and a device for processing a fibrous cable that is continuously fed at a high speed, such as 6000 meters per minute, for example, or more. In particular, this invention relates to a method of depositing in an orderly manner the cable into a container or cutting the cable into discrete staple fibers. This invention is also concerned with a device for carrying out the above method.

In order to brake the fibrous cable advancing at a high speed there have been known various methods and devices devised for a single purpose, namely to bring the fibrous cable to a zero speed.

For example, in the German patent application No. P 25 53 866.3 the advancing cable has been introduced into a rotary guiding tube and blown against the inner wall of a hollow braking cylinder and pressed thereagainst by centrifugal force to be braked and subsequently deposited into a container located underneath. In order to prevent aging or conditioning of the fibrous cable (preparation, finishing, water and so on) in the guiding tube it has been proposed (German patent application No. P 27 09 252.0) to arrange the perpendicular part of the guiding tube in the hollow shaft of the motor. This measure necessitates, however, a special design for the hollow motor shaft. The diameters of shafts of motors are standardized according to the motor power and consequently in a special construction employing a hollow shaft it is not the power of the motor but the axis which is to be taken into consideration.

The object of this invention is to avoid the disadvantages of prior art solutions and to find ways how to brake the fed cable exactly to zero speed without the danger of conditioning of fibrous cable and without making special structural modifications of existing devices of this kind.

Another object of this invention is to provide a method and device that, simultaneously with the braking of the cable, enables additional steps such as depositing the stationary cable at a low speed into containers or cutting the stationary cable into discrete staple fibers.

SUMMARY OF THE INVENTION

According to this invention the above objects are attained by coiling by means of a rotational guiding member the continuously fed cable on a stationary cylinder and pressing downwardly each new winding while the latter is being laid around the wall of the stationary cylinder so that the windings are shifted downwardly and the lowermost windings fall past the edge of the cylinder into a container or are cut by means of knives arranged around the bottom edge of the cylinder into discrete staple fibers.

A preferred embodiment of the device for carrying out the above method comprises a wobble plate arranged within the cylinder and having a plurality of fingers arranged about its periphery and projecting through corresponding vertical slits in the cylinder wall. Preferably, the stationary cylinder and the wobble plate are arranged around a lower part of the upright shaft whereas the hollow upper part of the shaft is located above the cylinder.

The wobble plate can be supported by means of ball bearings on an inclined collar or flange on the lower part of the shaft in such a manner that the uppermost fingers project always opposite to the outlet of the rotating guiding member for the cable or slightly above this outlet. An outer collar provided with vertical slits can also be arranged around the wobble parts so that the projecting fibers of the wobble plate are guided also in the slits of the outer collar. With advantage, the outlet part of the rotary member for the cable is directed perpendicularly downwardly.

According to this invention the fibrous cable is pulled through the guiding member under tension so that no sedimentation of fibers in the guiding tube takes place. The feeding speed of the cable on the cylinder is reduced to zero. Of course, a low speed sliding movement of the cable takes place due to the downward pressure exerted on the coiled cable by the wobble plate fingers. The method and device of this invention is suitable for cable feeding speeds exceeding 6000 meters per minute.

In addition, the processing method and device of this invention is suitable for cutting the fibrous cable into staple fibers. To this end a plurality of upwardly and outwardly inclined knives are arranged around the perimeter of the stationary outer collar surrounding the stationary cylinder so that the cable windings are pressed by means of the fingers of the wobble plate against the edges of the knives.

Preferably, the knives are insertable into the outer collar so that the upper part of the knives is outside the effective range of the fingers of the wobble plate. The lower part of the stationary cylinder can be provided also with slits for receiving and supporting the knives. The spacings between the slits in the cylinder corresponds of course to those in the outer collar.

In the application of this invention for cutting the cable into staple fibers, the stationary cylinder can be preferably supported in a pillar disconnectably attached to the lower base of the cylinder. The knives can abut at their lower part against grooves at recesses in the pillar. The knives are loosely insertable into those recesses and can be removed in oblique direction upwardly. The space below the knives is preferably enclosed by a metal sheet envelope that is provided with a suction device for discharging staple fibers accumulated in the space.

The device of this invention makes it possible to cut extremely short staple fibers at a high manufacturing speed. Since the knives can be arranged at arbitrary spacings around the stationary cylinder, it is possible to cut staple fibers having different lengths. Due to the loose support of the knives, it is possible to exchange the knives or to change the spacing therebetween also during the operation of the device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
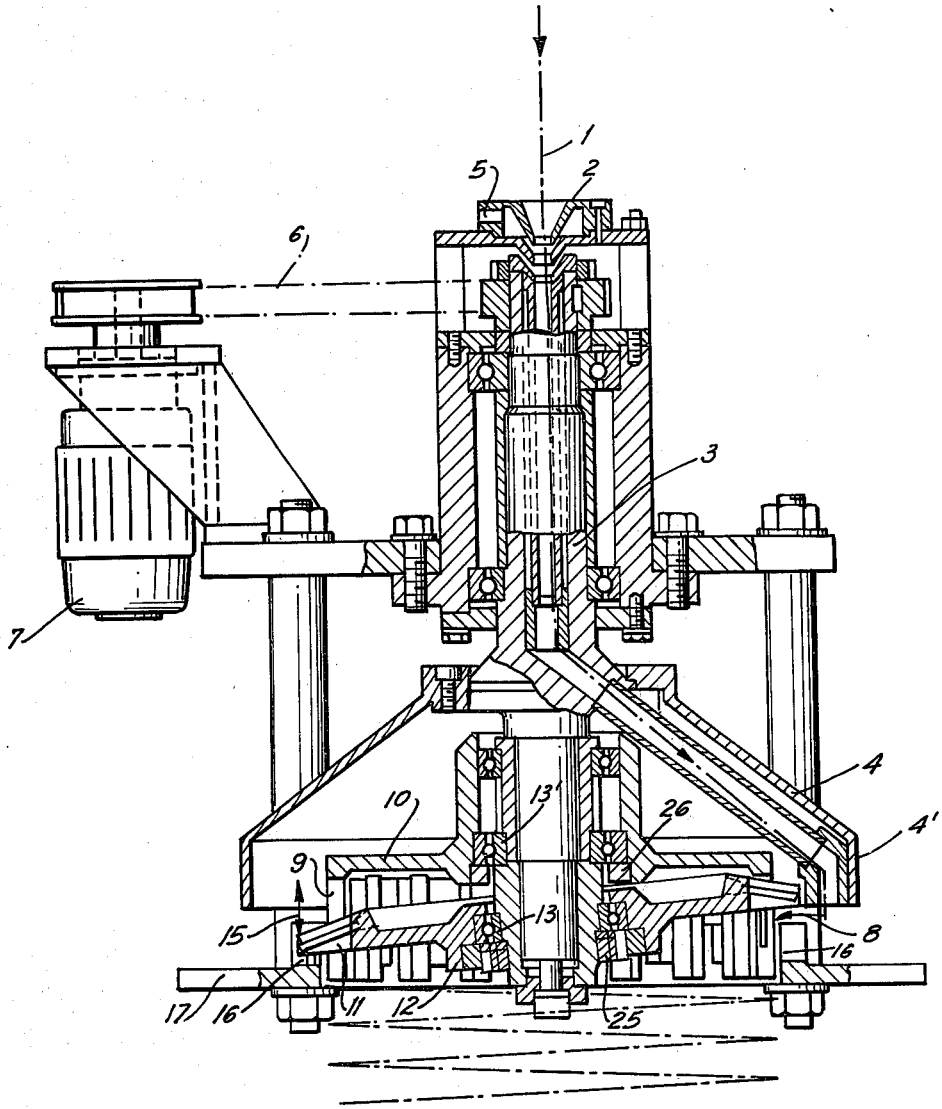
FIG. 1 is a sectional side view of one embodiment of the device of this invention.
Figure 2:
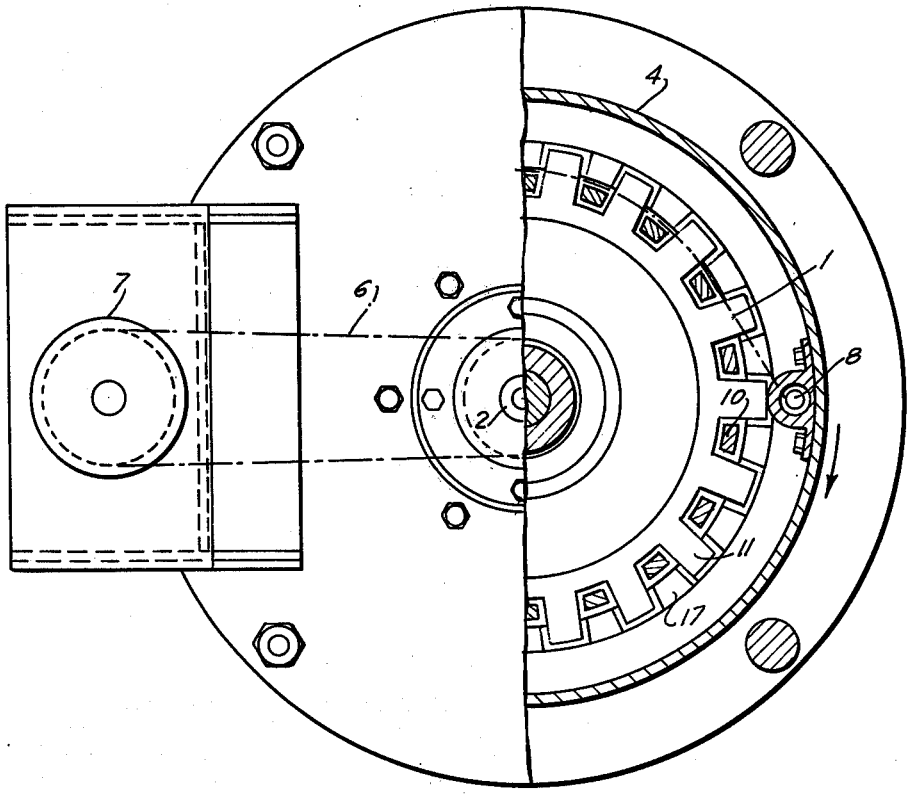
FIG. 2 is a top view, partly in section of the device of FIG. 1.

Referring now to FIGS. 1 and 2, fibrous cable 1 is introduced into an injection nozzle 2 and forwarded by suction through the hollow upper part of a shaft 3 into a downwardly projecting, tubular guiding member 4. Pressure air for the introduction of the cable 1 is fed through boring 5 located near the inlet nozzle 2. The injecting arrangement serves for starting the feeding movement of the cable 1 and as soon as the cable is coiled the pressure air through nozzle 5 is shut off. The rotational member 4 is driven via driving means 6 by an electromotor 7. Cable 1 exits from the outlet opening 8 of the rotational member 4 and is coiled around a stationary cylindrical wall 10 that around its periphery is provided with vertical slits 9. Inside the stationary cylinder 10 a wobble plate 12 having a plurality of projecting fingers 11 is arranged. The fingers 11 project through respective vertical slits 9 in the cylindrical wall 10. The wobble plate 12 surrounds the lower part 14 of the shaft 3 and is supported on a ball bearing 13 that is inclined relative to the axis of the shaft part 14. A ball bearing 13' is coaxially arranged between the stationary cylinder 10 and the shaft part 14 and is connected to the elevated surface portion of the wobble plate 12 by means of a ring 26. The inclined lower ball bearing 13 is seated on a correspondingly inclined collar 25 secured to the shaft part 14. In this manner, the rotational movement of the shaft is transferred via the bearing 13 to the wobble plate but due to the positive guiding of projecting fingers in vertical slots 9 in the cylindrical wall 10 the wobble parts 12 is prevented from rotation. The highest point of wobbling motion of fingers 11 is always opposite to the outlet of the rotating guiding member 4 whereby the lower surface of fingers 11 is slightly above the outlet opening so as to act against the cable 1 from above.

Due to the inclined position of the wobble plate 12 the fingers 11 always perform a wobbling motion in the direction of arrow 15. In this embodiment, an outer collar 17 is fixedly arranged around the cylinder 10 and is provided with vertical slits 16 into which the tips of fingers 11 project and thus prevent the wobble plate and the cylinder 10 from rotation. Since the vertically downwardly directed end portion 4' of the rotary guiding member 4 is juxtaposed to the highest point of the inclined wobble plate 12, the wobbling movement is synchronized with the discharge of the cable 1 from the outlet opening 8 so that fingers 11 are always above the cable 1 while the latter is being coiled on the cylindrical wall 10. The fingers 11 pass the windings downwardly into the gap between the cylindrical wall 10 and the outer collar 17 so that the cable windings slidably move downwardly until they are discharged past the lower edge of the cylinder 10. In this embodiment, a container (not shown) having either a cylindrical or other suitable shape can be placed below the stationary cylinder 10 and the falling cable windings are received in this container.

Figure 3:
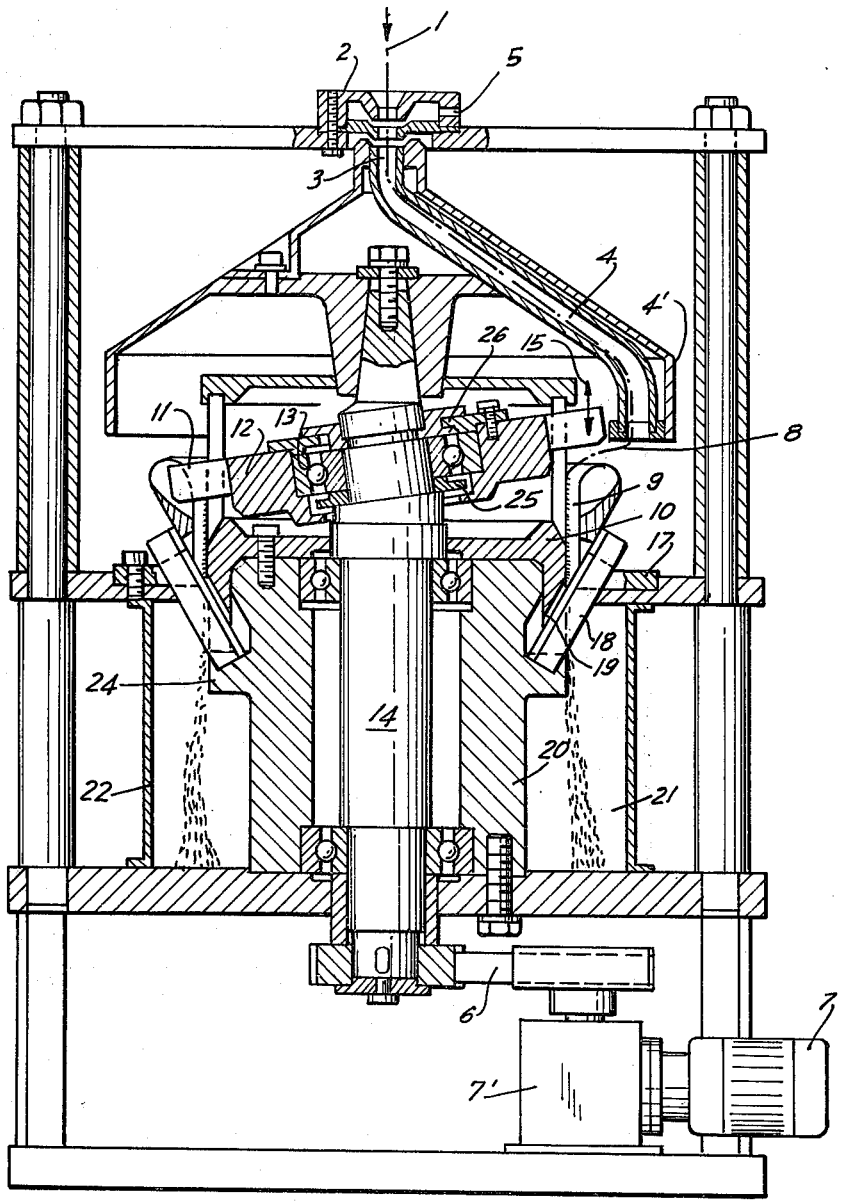
FIG. 3 is another embodiment of the device of this invention for cutting staple fibers.
Figure 4:
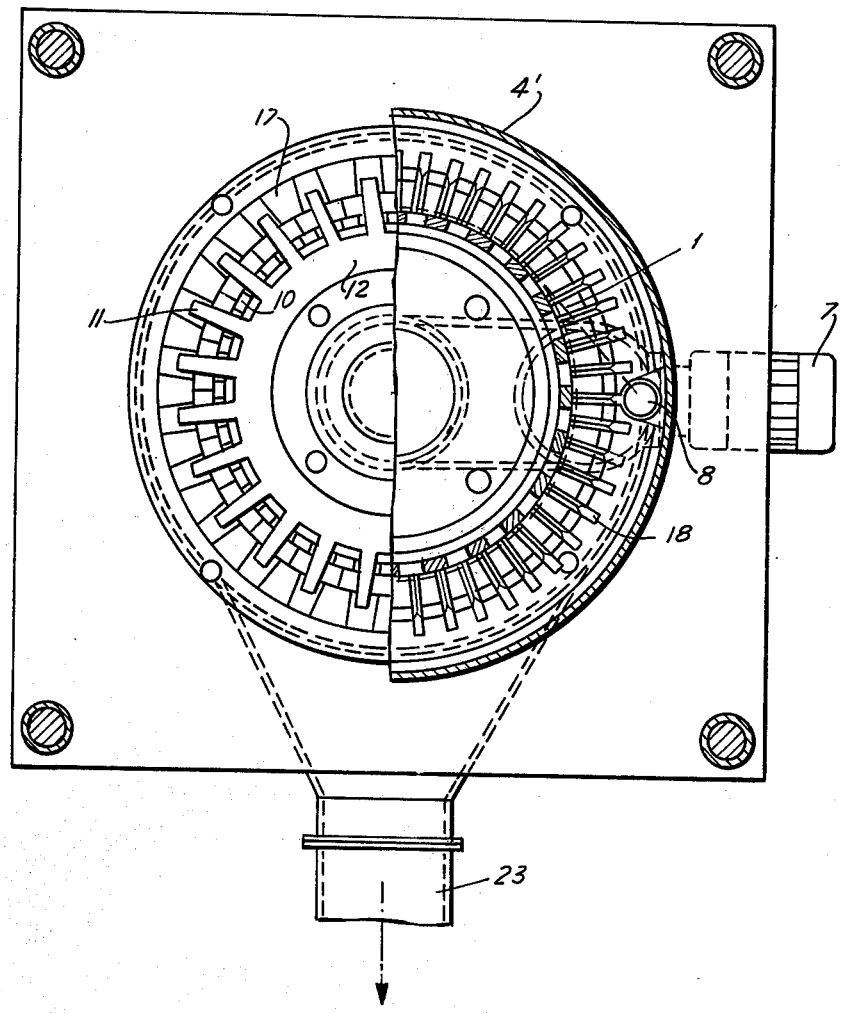
FIG. 4 is a sectional top view of FIG. 3 taken along two different sectional lines.

A modification of this invention is shown in FIGS. 3 and 4. Similarly as in the preceding embodiment the fibrous cable 1 is introduced into an inlet nozzle 2 and advanced by pressure air from opening 5 into an inlet part 3 of a projecting tubular guide 4 having a downwardly inclined outlet part 4'. The inlet 3 is coaxial with a shaft 14 located below and driven via the driving means 6 and 7' by an electromotor 7. Cable 1 is wound around the cylindrical wall 10 that is provided with a plurality of vertically directed longitudinal slits 9. Cylinder 10 is stationary and is disconnectably secured to a supporting pillar 20. Fingers 11 of wobble plate 12 engage into the slits 9. The wobble plate 12 is supported by means of a ball bearing 13 on an inclined collar 25 on the shaft 14. Due to this inclined support on the shaft 14, the wobble plate 12 with its fingers 11 performs a wobbling motion whereby its fingers 11 are successively vertically displaced in the direction of arrow 15. The rotary movement of the wobble plate 12 is prevented by the stationary cylinder 10 whose slits 9 confine and guide the projecting fingers of the wobble plate. A stationary outer ring or collar 17 surrounds the lower part of the cylinder 10 and is provided along its circumference with a plurality of slits into which downwardly inclined knives 18 are loosely inserted so that cable windings on the cylindrical wall 10 are pressed by wobbling fingers 11 against the cutting edges of those knives 18 and cut the cable into staple fibers. The outer ring 17 in the range of fingers 11 is provided also with guiding slits that assist in guiding the wobble plate 12. Also the cylinder 10 is provided with additional slits 19 spaced apart in accordance with the spacings between the knives 18 and together with a flange 24 on the support 20 form a plurality of sockets into which the knives 18 are loosely insertable or from which they can be easily withdrawn. The upper parts of the knives 18 terminate below the range of the wobbling fingers 11. The collar 24 is provided with recesses for receiving the lower part of the knives 18 and consequently the knives can be withdrawn obliquely upwardly. The cut cable pieces fall past knives 18 into an underlying space 21 that is surrounded by a metal sheet envelope 22. A suction conduit 23 opens into the space 21 and provides for withdrawal of the cut staple fibers from the space 21.

While the invention has been illustrated and described as embodied in two specific examples of the device for processing a fibrous cable, it is not intended to be limited to the details shown, since various modifications and structural changes may be made without departing in any way from the spirit of the present invention.

What is claimed as new and desired to be protected by Letters Patent is set forth in the appended claims.

1. A device for processing a continuously advancing fibrous cable comprising: an upright shaft supported for rotation about its axis, a downwardly projecting guiding member rotatable together with said shaft, said guiding member having an upper part coaxially arranged with said shaft and an outlet part directed downwardly and away from said shaft, a stationary cylindrical member arranged about said shaft and having a plurality of vertically directed slots provided in its periphery; a wobble plate disposed within said stationary cylindrical member around said shaft and having a plurality of fingers projecting through corresponding slots in said cylindrical member, said wobble plate being driven by said shaft for performing wobbling movement in a plane inclined relative to said shaft, the uppermost fingers of said wobble plate being directed opposite to the outlet of said guiding member to wind the cable on the cylindrical member under the pressure of said fingers.

2. A device as defined in claim 1, wherein said stationary cylindrical member is coaxially arranged about said shaft and coupled thereto by a ball bearing and said wobble plate being seated on a second ball bearing disposed on an inclined flange on said shaft.

3. A device as defined in claim 1, further including a stationary outer ring surrounding said cylindrical member and being uniformly spaced therefrom, said outer ring having a plurality of slots arranged opposite the slots in said cylindrical member for receiving the tips of fingers of said wobble plate.

4. A device as defined in claim 2, wherein the outlet end portion of said guiding member is directed perpendicularly downwardly.

5. A device as defined in claim 3, wherein said stationary cylindrical member is supported on ball bearings surrounding said shaft, further including a container disposed below said cylindrical member for receiving the discharged cable windings.

6. A device as defined in claim 3, further including a plurality of cutting means disposed between said cylindrical member and said outer ring to cut the discharged winding into discrete staple fibers.

7. A device as defined in claim 6, wherein said cutting means includes a plurality of knives supported at uniform intervals on said outer ring.

8. A device as defined in claim 7, wherein said stationary cylindrical member is disconnectably mounted to a supporting pillar having recesses for accommodating said knives in an upwardly inclined position.

9. A device as defined in claim 8, wherein upper parts of said knives terminate below the effective range of said fingers.

10. A device as defined in claim 9, wherein said stationary cylindrical member is provided with a plurality of additional slots for receiving the upper parts of said knives.

11. A device as defined in claim 8, wherein said knives are loosely insertable into said recesses.

12. A device as defined in claim 8, wherein the space below said knives is enclosed in an envelope.

13. A device as defined in claim 12, wherein a suction duct is connected to said space.

14. A device as defined in claim 1, wherein a pressure fluid inlet communicates with the upper part of said guiding member.

15. A device as defined in claim 1, wherein the upper part of said shaft is hollow and communicates with the upper part of said guiding member.

* * * * *